US005231453A

United States Patent [19]

Nakai et al.

[11] Patent Number: 5,231,453

[45] Date of Patent: Jul. 27, 1993

[54] IMAGE RECORDING APPARATUS WITH ROLLED PROTECTIVE COVER FOR PROCESS UNIT

[75] Inventors: Hitoshi Nakai; Yasushi Okabe; Shusaku Tsusaka; Soichiro Nishimura, all of Nagoya, Japan

[73] Assignee: Brother Kogyo Kabushiki Kaisha, Aichi, Japan

[21] Appl. No.: 872,150

[22] Filed: Apr. 22, 1992

[30] Foreign Application Priority Data

Apr. 23, 1991 [JP] Japan ..... 3-122290

[51] Int. Cl.[5] ..... G03G 15/00

[52] U.S. Cl. ..... 355/210; 355/211

[58] Field of Search ..... 355/200, 210, 211, 71

[56] References Cited

U.S. PATENT DOCUMENTS

| | | | |
|---|---|---|---|
| 4,462,677 | 7/1984 | Onoda | 355/210 |
| 4,470,689 | 9/1984 | Nomura et al. | 355/211 |
| 4,829,334 | 5/1989 | Takamatsu et al. | 355/309 |
| 5,061,959 | 10/1991 | Kinoshita et al. | 355/210 |

FOREIGN PATENT DOCUMENTS

| | | | |
|---|---|---|---|
| 51-2433 | 1/1976 | Japan . | |
| 57-89779 | 6/1982 | Japan . | |
| 57-123238[U] | 7/1982 | Japan . | |
| 57-211181 | 12/1982 | Japan . | |
| 58-54392[B] | 12/1983 | Japan . | |
| 63-9237[B] | 2/1988 | Japan . | |
| 63-194271 | 8/1988 | Japan | 355/210 |
| 63-262662 | 10/1988 | Japan | 355/210 |
| 1-45635[B] | 10/1989 | Japan . | |

*Primary Examiner*—Joan H. Pendegrass
*Attorney, Agent, or Firm*—Oliff & Berridge

[57] ABSTRACT

One unit type processing unit to be assembled in a laser printer for facilitating replacement work. The processing unit houses therein a photosensitive drum with a part being exposed, a charging unit, a developing unit and cleaning unit. The processing unit is also provided with a flexible protective cover for covering the exposed area of the photosensitive drum when an upper frame of the laser printer is opened. The protective cover can be rolled into a compact configuration and is positioned in a dead space at a position beside the exposed area when the cover is moved away from the exposed area and when the upper frame is closed for printing operation. The rolled cover is stretchable to cover the exposed area when the upper frame is opened.

17 Claims, 8 Drawing Sheets

IMAGE RECORDING APPARATUS WITH ROLLED PROTECTIVE COVER FOR PROCESS UNIT

BACKGROUND OF THE INVENTION

The present invention relates to a processing unit for use in an electrophotographic type image recording apparatus such as a copying machine, a printer and a facsimile, and to the image recording apparatus incorporating the processing unit.

According to a conventional electrophotographic type image recording apparatus, electrostatic latent image is formed on a charged photosensitive member such as a photosensitive drum upon exposure, and the latent image becomes visible upon developing operation, and the visible image is electrostatically transferred onto an image recording medium by an image transferring process. Such sequential process is generally referred to as "Carlson process".

Further, widely available is a replaceable processing unit in which various components such as a photosensitive drum and expendable such as developer materials for image formation are assembled and accommodated. If the components' life span is expired and the expendables are used up, the unit is replaced with a new processing unit. Examples of such processing unit is disclosed in a Japanese Patent Publication Nos. 58-54392 and 63-9237.

A conventional laser printer incorporating therein the processing unit is shown in FIGS. 1 and 2. A laser printer 10 has a lower box frame 12 and an upper box frame 11 which is pivotally movable about an axis of a support shaft 13 relative to the lower box frame 12. In the upper box frame 11, a processing unit 30 having a photosensitive drum 31 for image formation is detachably assembled. Further, in the upper box frame 11, there are provided a scanner unit 21 and a discharge tray 18. The scanner unit 21 is adapted for scanning laser beam modulated by an image recording signal onto the photosensitive drum 31. The discharge tray 18 is adapted for receiving sheets on which visible images are formed. On the other hand, the lower box frame 12 houses therein a sheet cassette 14 in which fresh sheets are stored, a sheet feed roller 15, a sheet guide 16 which defines a sheet path, a charger 17 for electrostatically transferring a visible image on the photosensitive drum 31 onto the sheet, and an image fixing unit 20 for fixing the transferred image on the sheet.

The processing unit 31 has an outer frame formed with an opening 33 through which the scanning laser beam is passed for forming the electrostatic latent image on the photosensitive drum 31. The processing unit 30 houses therein the photosensitive drum 31 as a photosensitive means, a primary charger 32 for uniformly charging a surface of the photosensitive drum 31, a developing means 34, and a cleaning means 37. The developing means 34 is adapted for developing the electrostatic latent image on the photosensitive drum 31 with toner to form a visible toner image. The cleaning means 37 is adapted for scraping the residual toner from a surface of the photosensitive drum, the toner having not been transferred onto a sheet S at the time of transferring process by means of the charger 17 and for collecting the residual toner. The processing unit 30 is detachably attached to the upper box frame 11 through a unit support (not shown).

If sheet jamming occurs during printing operation of the laser printer 10 or, if the processing unit 30 is to be replaced with a new unit, the upper box frame 11 is pivotally moved upwardly about the axis of the support shaft 13 as shown in FIG. 2, so that the sheet feed path defined by the sheet guide 16 is exposed. Thus, the sheet S can be removed or the processing unit 30 can be exchanged with a new unit.

On the other hand, when the upper box frame 11 is opened, the photosensitive drum 30 may be exposed to an external light to lower charging efficiency. Further, the photosensitive drum is recently formed of an organic photo conductor (OPC) material since the material sufficiently yields productivity and facilitates scrapping. This OPC material has lower surface hardness in comparison with a selenic alloy conventionally used as the material of the photosensitive member. Therefore, the surface of the OPC drum may be damaged at the time of sheet removal work done by an operator. Furthermore, the photosensitive surface of the drum may be contaminated with oils and fats if the operators finger touches the surface. Thus, toner may be adhered to the oil affixed portion at the time of developing operation to degrade final output image.

In order to overcome these drawbacks, a protective cover has been proposed which covers the surface of the photosensitive drum when opening the upper box frame 11. For example, as disclosed in a Japanese Utility Model Application Kokai (OPI) No. 57-123238, a protective cover is movable cooperably with the opening/closing operation of a sheet feed unit.

Further, Japanese Patent Publication No. 1-45635 discloses a protective cover shown in FIGS. 3 and 4. This publication discloses a drum protective cover 60 movable between a drum covering position (FIG. 4) for covering an exposed surface of a photosensitive drum and a retracted position (FIG. 3) away from the exposed surface thereof. The protective cover 60 is a rigid extrusion molded resin product having a curvature substantially coincident with a curvature of the photosensitive drum.

The protective cover 60 is supported rotatably by one end of a first swing arm 61 whose another end is supported rotatably and coaxially with a drum 31 of a processing unit. The protective cover is also supported rotatably by one end of a second swing arm 62 whose another end is fixed to a rotatably shaft 63. The first swing arm 61 is urged in a counterclockwise direction in FIG. 4 by a biasing means. The rotatable shaft 63 is fixed with an operation level 65. Further a projection upstandingly extends from a lower frame.

Since the first swing arm 61 is biased in the direction, the protective cover 60 is urged to be positioned into the drum covering position (FIG. 4). However, if an upper frame is closed, the operation lever 65 is brought into abutment with the projection 66 so as to rotate the second swing arm 62 in a clockwise direction against the biasing force of the biasing means. Therefore, the protective cover 60 is brought into the retracted position to expose the photosensitive drum 31.

In the above described conventional device shown in FIGS. 1 through 4, developer toners accumulated in the developing means 34 (FIG. 1) of the processing unit 30 may undergo consumption in accordance with the numbers of printing. On the other hand, toners which have not been transferred but remained on the drum are collected into the cleaning means 37. Further, chargeability and exposure characteristic of the photosensitive drum 31 may be degraded in accordance with the repeated numbers of the printing process. For example, according to the conventional photosensitive drum formed of OPC and having a diameter of 30 mm, the drum has a service life capable of printing about 3000 to 5000 sheets of A4 size sheets. Therefore, such expendable supplies must be replaced by new supplies at every predetermined numbers of printings.

In order to reduce labors for such replacement and to eliminate any trouble of leakage of wasted toners at the time of the replacement, one unit type processing unit has been widely used in which the processing means are accommodated in a one integral assembly unit. Such integral unit is designed such that the service life of the photosensitive drum, use-up period of the developer toners in the developing means 34 and filling-up period of the wasted developer toners collected by the cleaning means 37 are approximately coincident with one another. With this arrangement, the integral processing unit is replaced by a new integral processing unit when all these means substantially simultaneously reach the service lives. Thus, expedient replacement is achievable.

However, in a recent improvement on OPC material, a photosensitive drum having a diameter of 30 mm can provide prolonged service life capable of performing printing from 10,000 to 20,000 numbers of sheets. Toner amounts to be used for printing 10,000 numbers of sheets may be about 600 grams assuming that printing area ratio is 5% and the toner is made of one component type magnetic toners, even though the toner amount may be dependent on the developing mode and method. Toner transferring efficiency given by the charger may generally be from 75% to 85%. Therefore, about 120 grams of toners are collected in a waste toner container of the cleaning means. Therefore, the volume of the collected toners is about 240 cc assuming that bulk density of the is 0.5 g/cc.

In order to provide the consistency of developing means and the cleaning means with the service life of the photosensitive drum which can have much prolonged service life, the developing means and the cleaning means must have large volume several times as large as the conventional volumes so as to accumulate larger volume of the developer toners therein.

A toner container of the developing means may be easily replaced by a new container if the toners are used up. However, it would be rather difficult to discharge wasted toners in a container of the cleaning means into another container in case of the integral type processing unit, due to the problem of leakage of the wasted toners. Consequently, the integral type processing unit must provide large volume of the wasted toner container of the cleaning means for facilitating replacement work.

SUMMARY OF THE INVENTION

With the above in view, inventors have drawn their attention to the application of the above described conventional protective cover into the integral one unit type processing unit having prolonged service life, and found deficiencies of such application. That is, if a printer device is at its print operable state shown in FIG. 1, the protective cover must be retracted away from the exposed surface of the photosensitive drum, and further, the protective cover must be positioned so as not to prevent a printing sheet from being fed. Therefore, a part of spaces for the developing means and the cleaning means must be used for the retracting space of the protective cover. In the illustrated example shown in FIG. 1, a lower space of the wasted toner container of the cleaning means can be allotted for the retractable or accommodation space of the protective cover.

In the retracted position of the protective cover, the cover should be positioned close to the lower surface of the container so as to avoid interference of the cover with sheet running through the sheet feed passage. Accordingly, volume of the waste toner container must be subjected to limitation, and consequently, service life of the entire processing unit is obliged to be shortened, in spite of prolonged service life of the photosensitive drum.

The present invention has been achieved in an attempt to overcome the above described drawback, and it is an object of the present invention to provide a processing unit and an image recording apparatus having the processing unit capable of minimizing an accommodation space of a protective cover when the cover is moved to the retracting position away from the drum, to thereby maintain occupying space of the processing unit, to thus prolong a service life of the entire processing unit.

This and other object of the invention will be attained by providing an electrophotographic type processing unit comprising an outer frame including a pair of side frames, a photosensitive drum, at least one image processing means, a protective cover, rolling means, and moving means. The photosensitive drum has an exposed area for electrostatically transferring a toner image, and dead spaces are provided at both sides of the exposed area. The photosensitive drum is supported by a rotation shaft rotatably supported by the pair of side frames. The at least one image processing means is disposed at a position adjacent the photosensitive drum. The protective cover is adapted for covering the exposed area of the photosensitive drum during inoperative state of the processing unit. The protective cover is formed of a flexible material and has one end, another end and side edges. The rolling means is adapted for rolling the protective cover during operative state of the processing unit to provide a rolled protective cover for retracting the protective cover away from the exposed area and for positioning the rolled protective cover in one of the dead spaces. The moving means is adapted for moving the protective cover to a first direction to cover the exposed area.

In another aspect of the invention, there is provided an image recording apparatus for electrostatically transferring toner image onto an image receiving sheet comprising: (a) lower frame, (b) an upper frame pivotally movable with respect to the lower frame for providing open and close position, and (c) the processing unit detachably assembleable to the upper frame. The processing unit includes (a) an outer frame including a pair of side frames, (b) a photosensitive drum having an exposed area for electrostatically transferring a toner image, dead spaces being provided at both sides of the exposed area, the photosensitive drum being supported by a rotation shaft rotatably supported by the pair of side frames, (c) at least one image processing means disposed at a position adjacent the photosensitive drum, (d) a protective cover for covering the exposed area of the photosensitive drum during open state of the upper frame, the protective cover being formed of a flexible material and having one end, another end and side edges, (e) rolling means for rolling the protective cover during closing state of the upper frame to provide a rolled protective cover for retracting the protective cover away from the exposed area and for positioning the rolled protective cover in one of the dead spaces, and (f) moving means for moving the protective cover to a first direction to cover the exposed area.

DETAILED DESCRIPTION OF THE PREFERRED EMBODIMENTS

Figure 1:
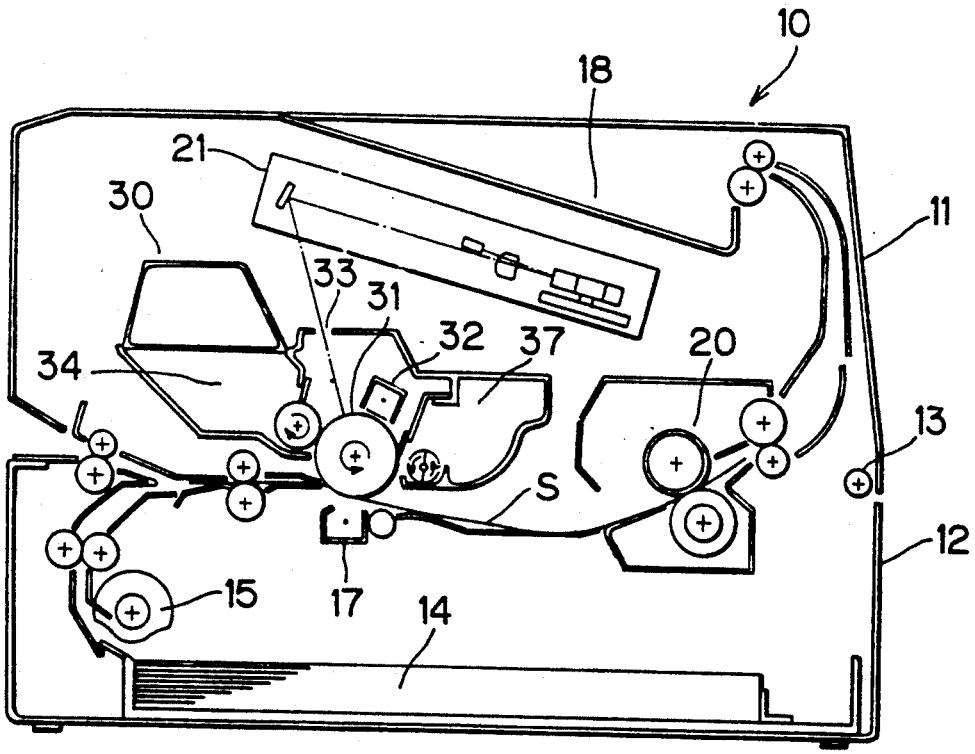
FIG. 1 Prior Art
FIG. 1 is a schematic view showing a laser printer according to one conventional example in which no protective cover is provided, and an upper box frame is closed on a lower box frame.
Figure 2:
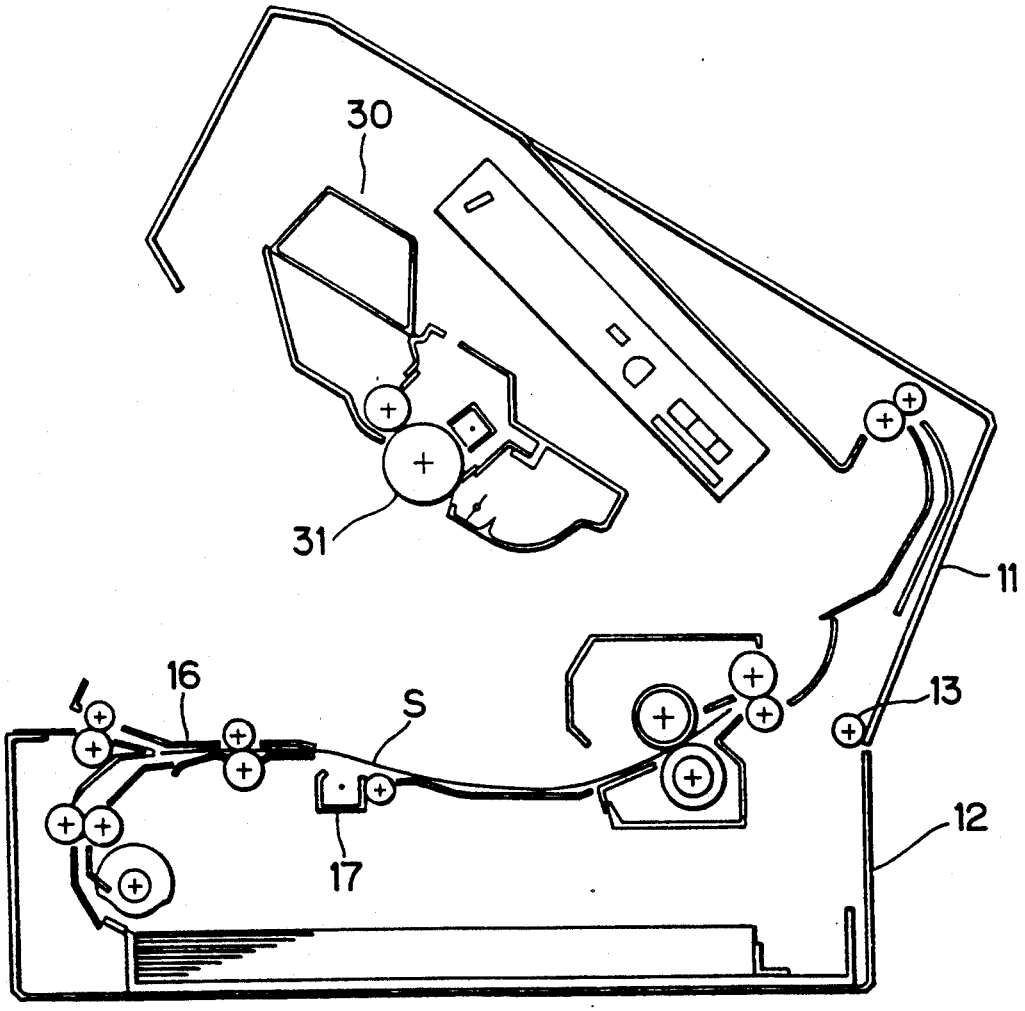
FIG. 2 Prior Art
FIG. 2 is a schematic view showing the laser printer in which the upper box frame is opened with respect to the lower box frame.
Figure 3:
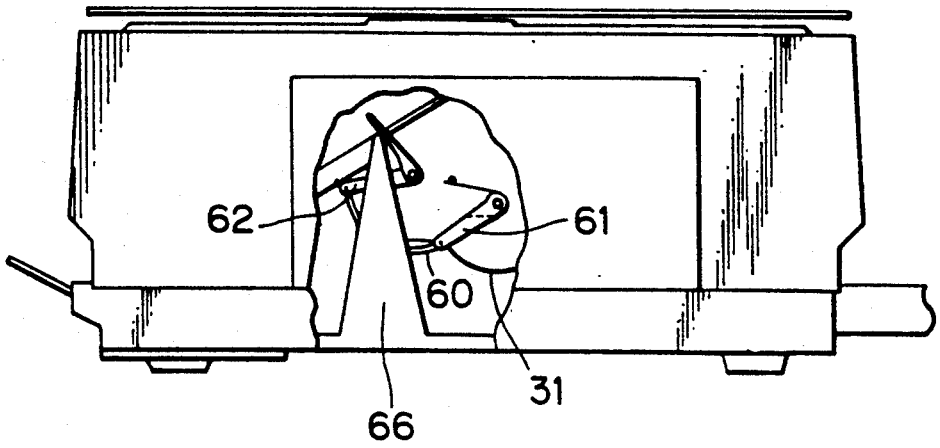
FIG. 3 Prior Art
FIG. 3 is a schematic view showing a laser printer according to another conventional example in which a protective cover for covering a photosensitive drum is provided and an upper box frame is closed on an lower box frame.
Figure 4:
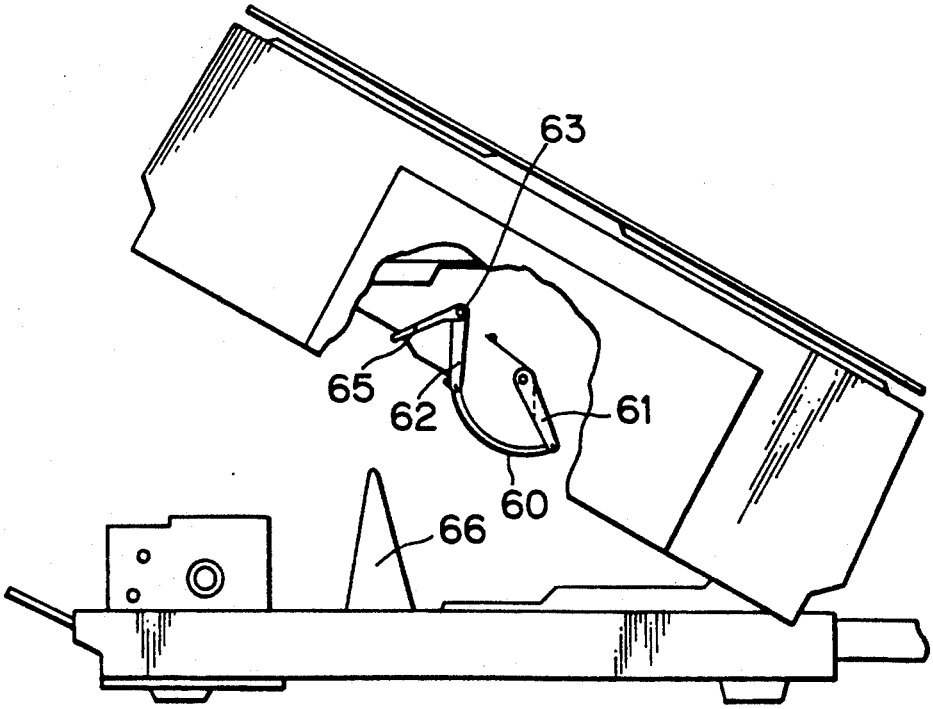
FIG. 4 Prior Art
FIG. 4 is a schematic view showing the laser printer of FIG. 3 and showing a state where the upper box frame is opened relative to the lower box frame.
Figure 5:
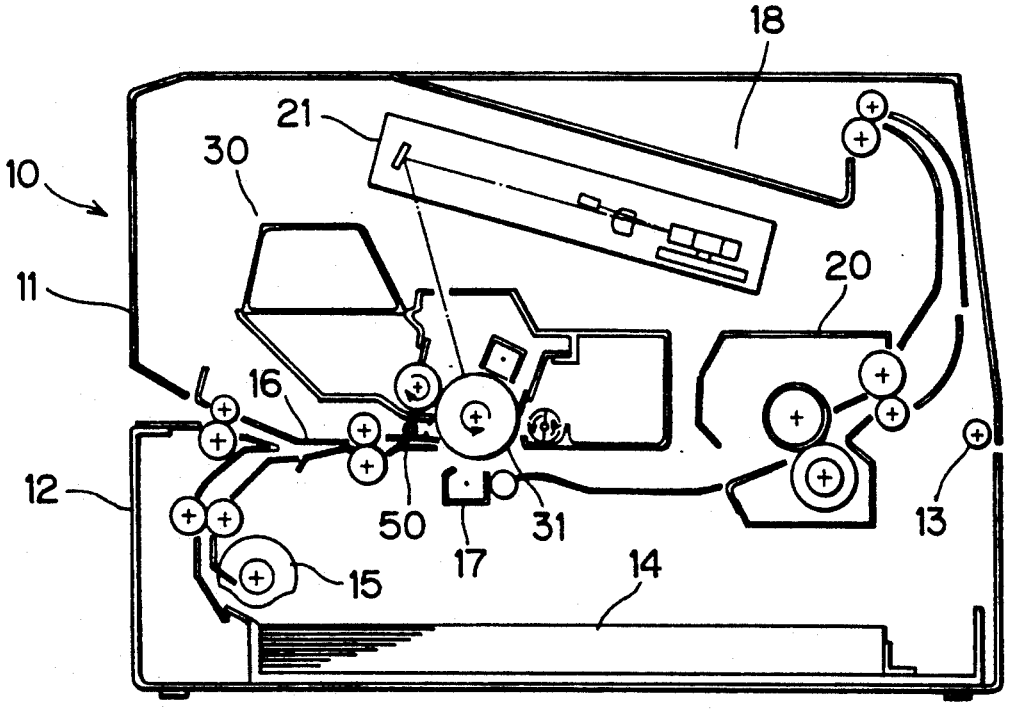
FIG. 5 is a schematic view showing a laser printer incorporating a processing unit having a protective cover according to a first embodiment of the present invention.

A processing unit according to a first embodiment in conjunction with a laser printer will be described with reference to FIGS. 5 through 9. General arrangement of the laser printer is shown in FIG. 5 wherein like parts and components are designated by the same reference numerals as those shown in FIGS. 1 through 4. In FIG. 1, a laser printer 10 has an upper box frame 11 pivotably supported by a lower box frame 12 by virtue of a pivot shaft 13. The upper box frame 11 accommodates therein a processing unit 30 having a photosensitive drum 31, a laser scanner unit 21 and a sheet discharge tray 18 on which printed sheets are stored. The lower box frame 12 accommodates therein a sheet cassette 14, a sheet feed roller 15, a sheet feed guide 16, a charger 17 for electrostatically transferring toners on the drum onto a sheet, and an image fixing means 20 for fixing the thus transferred toner image onto the sheet.

The processing unit 30 includes a pair of side walls 30*a*, 30*b*, and a pin 56 extends from one of the side walls 30*a* in an axial direction of the photosensitive drum 31. In the processing unit 30, a part of the photosensitive drum 31 is exposed. Dead spaces are conventionally provided at both sides of the exposed area of the photosensitive drum.

Figure 6:
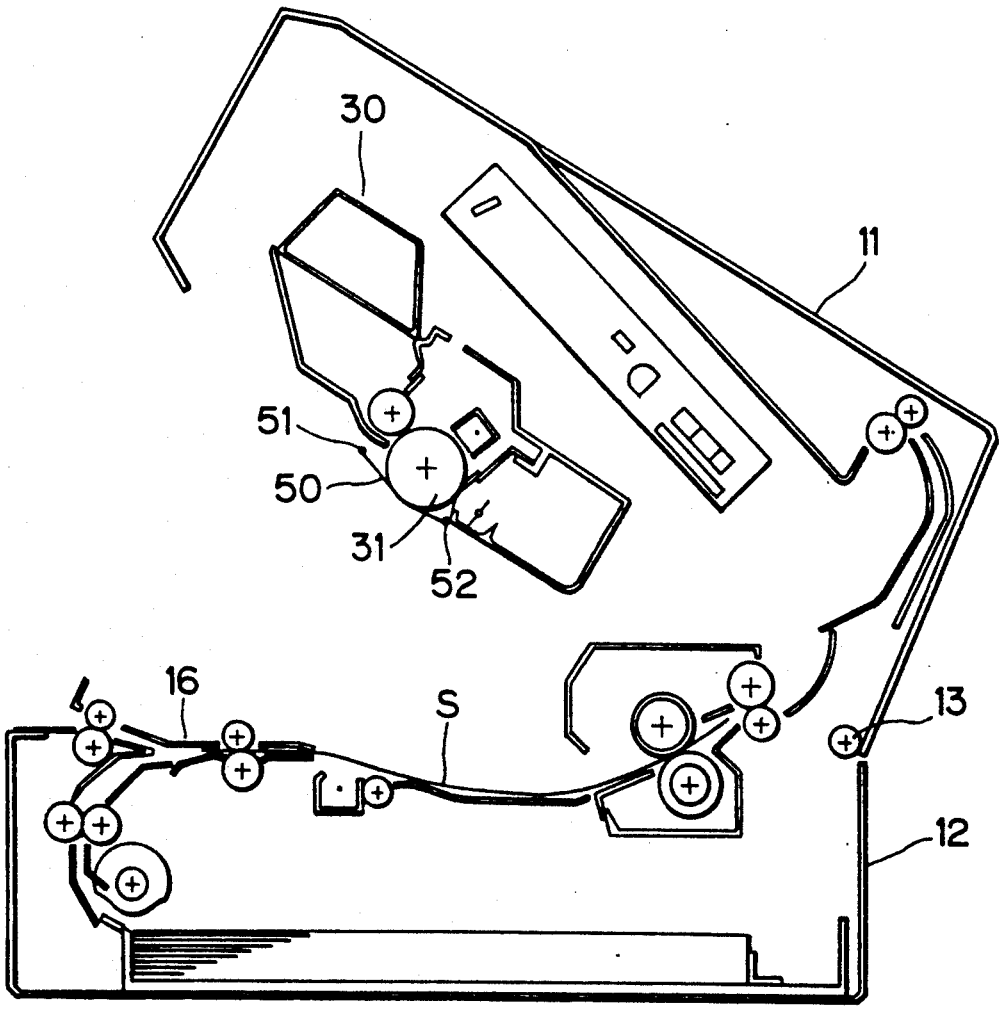
FIG. 6 is a schematic view showing the laser printer of FIG. 5 and showing a state in which an upper box frame is opened relative to a lower box frame.

A protective cover 50 for covering the exposed area of the drum is disposed at a position adjacent the exposed area. As shown in FIG. 5, the protective cover 50 is accommodated in a rolled fashion in one of the dead space when the printer is at its operative state where the upper box frame 11 is closed on the lower box frame 12. In this state, sheet travel and toner transferring operation are not interfered by the protective cover 50. On the other hand, as shown in FIG. 6, the drum protective cover 50 extends between a fixed shaft 51 and a movable shaft 52 so as to cover the exposed area of the photosensitive drum 31 when the upper box frame 11 is opened.

Figure 7:
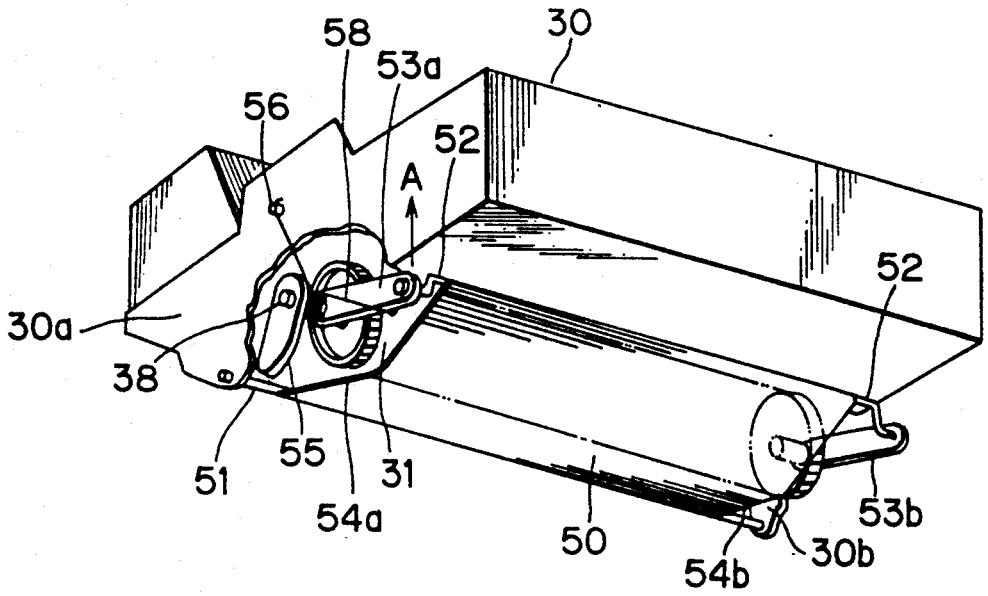
FIG. 7 is a perspective view showing the processing unit in which the protective cover and moving means therefor are provided.

The drum protective cover 50 is best shown in FIG. 7. The protective cover 50 is formed of light shieldable and flexible material having a thickness ranging from 50 to 200 micron meters. For example, the cover 50 is constituted by a resin film made of polyethylene terephthalate (PET), low density polyethylene (LDPE), or a fabric made of polyethylene fiber, polyamide fiber or polyester fiber. Other materials may be available as far as the selected material is capable of shutting off the light ranging in spectral sensitivity region of the photosensitive drum, and the material can protect a photosensitive surface of the drum against physical damage.

The protective cover 50 has one end fixed to the fixed shaft 51 rotatably supported by the side walls 30*a*, 30*b* of the processing unit 30. The protective cover 50 has another end fixed to the movable shaft 52 rotatably supported by a pair of link arms 53*a*, 53*b*. The protective cover 50 has a width in an axial direction of the photosensitive drum 31, the width being sufficient for covering a print area of the drum 31. Further, the cover 50 has a length in a circumferential direction of the drum 31, the length being sufficient capable of providing abutment of the movable shaft 52 onto a lower surface of the cleaning means 37.

Side edges of the protective cover 50 are fixed to coil springs 54*a*, 54*b* curled in vortex fashion. Each of the coil springs 54*a*, 54*b* has an outer diameter ranging from 5 to 15 mm and is formed of steel wire such as a stainless steel wire and a piano wire. Therefore, in a free state of the photosensitive cover 50, the cover 50 is rolled about a center axis of the shaft 51 because of a restoration force of the coil springs 54*a*, 54*b* which have been subjected to curling.

Figure 8:
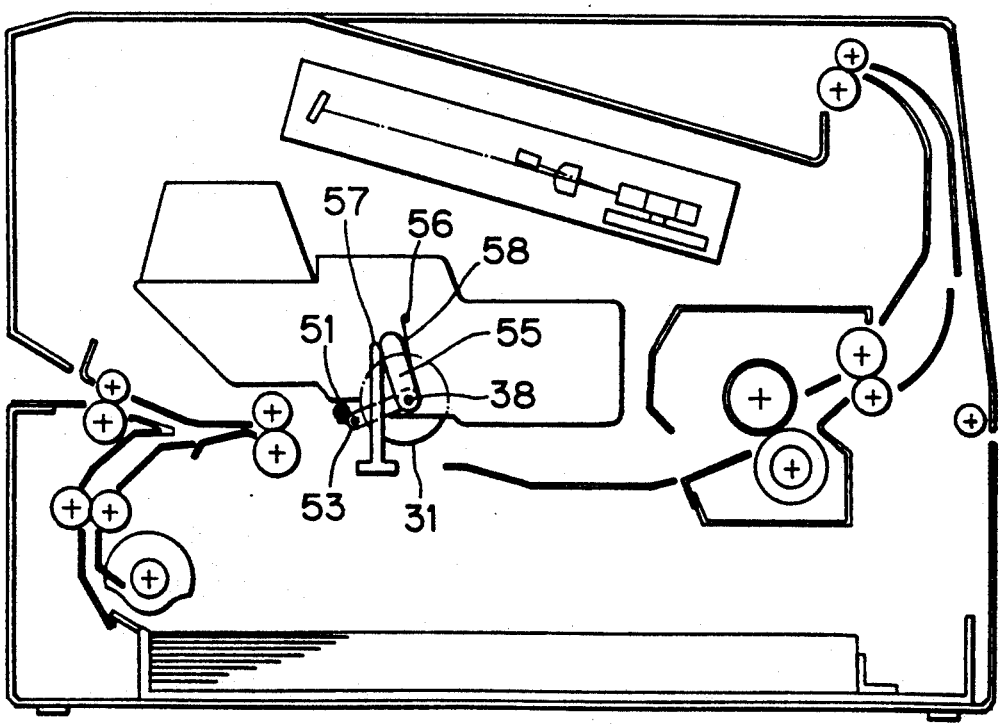
FIG. 8 is a schematic view for description of operation of the protective cover moving means when an upper box frame is closed.
Figure 9:
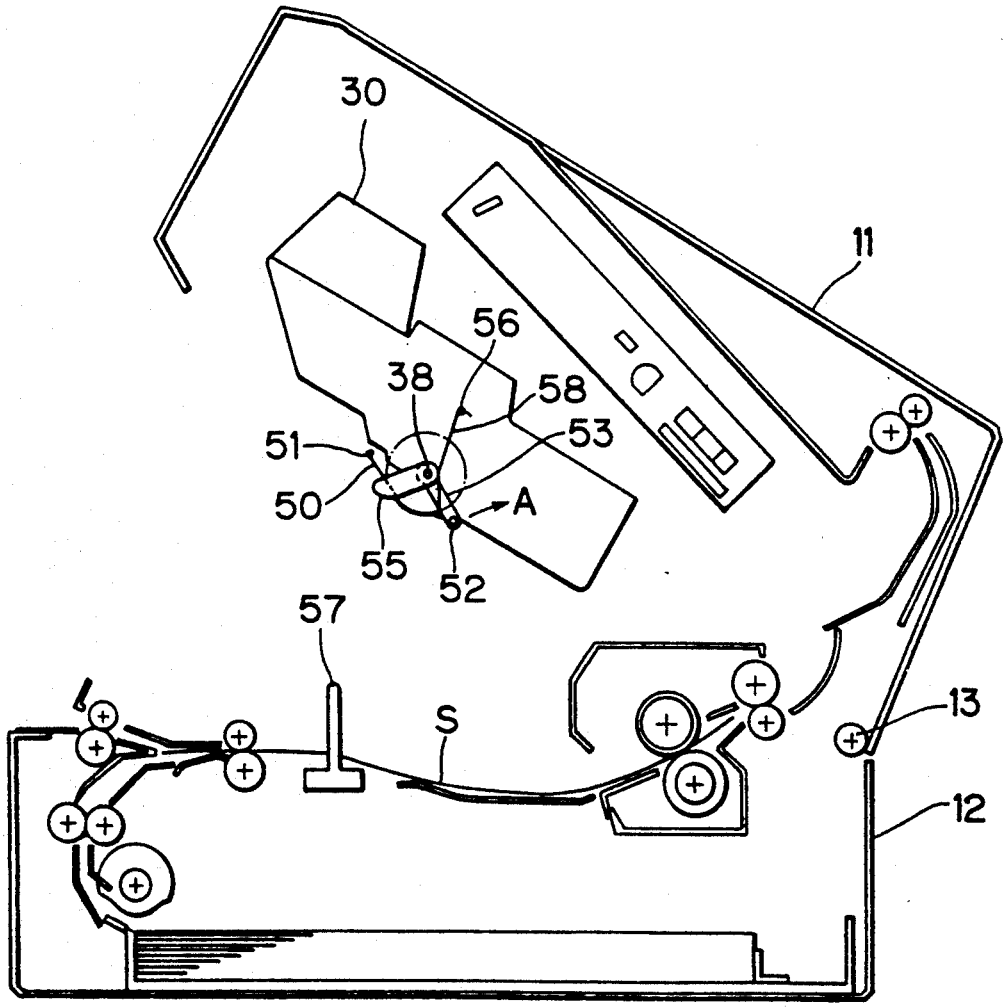
FIG. 9 is a schematic view for description of operation of the protective cover moving means when an upper box frame is opened.

A protective cover moving mechanism is shown in FIGS. 7 through 9. In FIG. 7, a rotation shaft 38 of the photosensitive drum 31 is rotatably supported by the side walls 30*a*, 30*b*. The pair of link arms 53*a*, 53*b* are rotatably connected to the rotation shaft 38 at both sides of the photosensitive drum 31. Further, another link arm 55 is provided rotatably on the rotation shaft 38 and integrally with one of the link arms 53*a*. The other link arm 55 and the link arm 53*a* provide a given angle therebetween. A torsion spring 58 is mounted on the rotation shaft 38. The torsion spring 58 has one end engaged with the link arm 53*a* and another end engaged with the pin 56. Thus, the link arm 53*a* is urged to be rotated in a direction indicated by an arrow A in FIG. 7.

Since the movable shaft 52 is connected between free ends of the link arms 53*a*, 53*b*, the protective cover 50 is urged to be extended to cover the exposed area of the photosensitive drum 31 because of the biasing force of the torsion spring 58. In this connection, the biasing force of the torsion spring 58 is set greater than that of the coil springs 54a 54b in order to permit the protective cover to fully move to cover the exposed area in overcoming the biasing force of the coil springs 54a, 54b. When the upper box frame 11 is opened, the protective cover 50 is adapted to fully extend and cover the exposed area of the photosensitive drum 31.

A projection member 57 upwardly extends from the lower box frame 12. The projection member 57 is positioned at a position in abutment with the other link arm 55 when the upper box frame 11 is moved from its open position to the close position. Therefore, in closing operation of the upper box frame 11, the other link arm 55 is brought into abutment with the projection member 57, so that the other link arm 55 is rotated in a direction opposite the arrow A about an axis of the rotation shaft 38 against the biasing force of the torsion spring 58 as shown in FIG. 8.

In operation, in a state where the upper box frame 11 is opened as shown in FIG. 9 for processing sheet jamming or for replacement of the entire processing unit, the link arms 53a, 53b and the other link arm 55 are rotated in the direction A because of the biasing force of the torsion spring 58. Therefore, the leading end of the protective cover 50 is moved to cover the exposed area of the photosensitive drum 31 while trailing end of the cover is fixed by the stationary shaft 51. The movable shaft 52 is stopped in abutment with the lower surface of the cleaning means of the processing unit. Thus, the exposed area of the photosensitive drum 31 is fully covered by the protective cover 50. Accordingly, the photosensitive drum 31 is protected against an external light and injury.

On the other hand, if the upper box frame 11 is moved toward its closing position, the link arm 55 is brought into abutment with the projection member 57. In accordance with the further closing motion of the upper box frame 11, the link arms 55 and 53a, 53b are rotated in the direction opposite the arrow A, so that the drum cover 50 is rolled by the curling force of the coil springs 54a, 54b. Thus, the protective cover 50 is moved away from the exposed area of the photosensitive drum 31 at a position below the developing means and greatly above a sheet feed passage. Since the rolled protective cover 50 is of compact configuration in comparison with the conventional rigid and arcuate protective cover, the rolled protective cover 50 can be positioned in the dead space, and the rolled retracted position of the protective cover 50 does not interrupt the sheet travel without reducing volume of the developing means and the cleaning means in the processing unit. In other words, effective volume of the entire processing unit can be maintained, yet providing retracting space of the compact protective cover 51.

Figure 10:
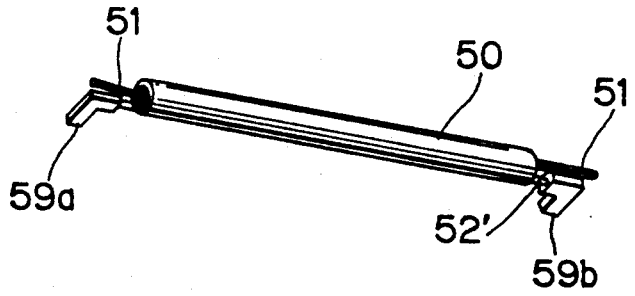
FIG. 10 is a perspective view showing a protective cover in its rolled state according to a second embodiment of this invention.
Figure 11:
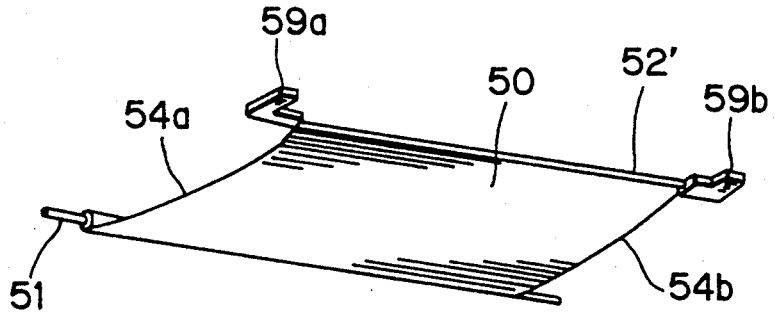
FIG. 11 is a perspective view showing an extension state of the protective cover according to the second embodiment.
Figure 12:
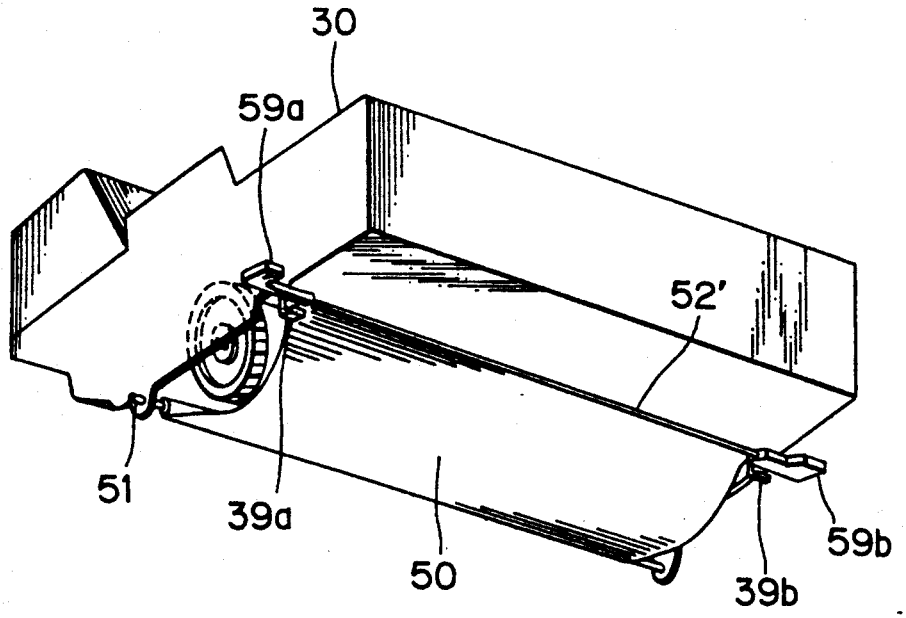
FIG. 12 is a perspective view showing the processing unit with the extended protective cover according to the second embodiment of this invention.

According to a second embodiment, the protective cover 50 can be manually moved as shown in FIGS. 10 through 12. Similar to the foregoing embodiment, the side edges of the protective cover 50 are fixed to the curled coil springs, and one end of the protective cover 50 is fixed to the shaft 51. Another end of the protective cover is fixed to a movable shaft 52' whose end portions are provided with a pair of manual knobs 59a, 59b. On the other hand, a pair of hooks 39a, 39b are provided at the lower portion of the processing unit at a position below the cleaning means.

The protective cover 50 has a rolled shape as shown in FIG. 10 during printing operation or when the upper box frame is closed. On the other hand, the cover 50 largely extends as shown in FIGS. 11 against the biasing force of the curled coil spring from the shaft 51 over the exposed area of the photosensitive drum 31 as shown in FIG. 12 and the knobs 59a, 59b are engaged with the hooks 39a, 39b to maintain the extension.

As described above, the processing unit of this invention can provide a compact protective cover when the cover is at its retracted position. Since dead spaces are conventionally provided at a position immediately beside the exposed area of the photosensitive drum, and since the rolled protective cover is of compact size, the rolled protective cover can be positioned in the dead space. Accordingly, effective volume of the processing unit can be maintained without reducing the volume of the wasted toner container, to thereby prolong service life of the processing unit. In other words, it is unnecessary to reduce the size of the entire processing unit in an attempt to provide a retracting space of the protective cover. Further, resultant arrangement has a simple structure and is capable of moving the cover over the exposed area and away from the exposed area of the photosensitive drum in accordance with the opening/closing operation of the upper box frame.

While the invention has been described in detail and with reference to specific embodiment thereof, it would be apparent to those skilled in the art that various changes and modifications may be made therein without departing from the spirit and scope of the invention. For example, in the first embodiment, the movement of the protective cover 50 toward the drum covering position in accordance with the opening motion of the upper box frame is performed by the torsion spring 58 and the link arms 53a, 53b, 55. However, the cover moving mechanism is not limited to such arrangement. For instance, a detection means is provided for detecting opening/closing motion of the upper box frame 11. The detection means generates a detection signal. Electrical equipment such as a motor and solenoid can be provided for moving the protective cover in response to the detection signal. In another modification, the protective cover can be positioned at another dead space and below the cleaning means in the retracted position of the cover. In this case, the protective cover unrolledly extends toward the lower portion of the developing means exceeding over the exposed area of the photosensitive drum.

What is claimed is:

1. An electrophotographic type processing unit comprising:

an outer frame including a pair of side frames;

a photosensitive drum having an exposed area for electrostatically transferring a toner image, dead spaces being provided at both sides of the exposed area, the photosensitive drum being supported by a rotation shaft rotatably supported by the pair of side frames;

at least one image processing means disposed at a position adjacent the photosensitive drum;

a protective cover for covering the exposed area of the photosensitive drum during inoperative state of the processing unit, the protective cover being formed of a flexible material and having one end, another end and side edges;

rolling means for rolling the protective cover during operative state of the processing unit to provide a rolled protective cover for retracting the protective cover away from the exposed area and for positioning the rolled protective cover in one of the dead spaces; and moving means for moving the protective cover in a direction to cover the exposed area.

2. The electrophotographic type processing unit as claimed in claim 1, wherein the rolling means comprises:

a first shaft supported between the pair of side frames and at a position adjacent the one of the dead spaces, the one end of the protective cover being fixed to the first shaft; and a pair of curled coil springs disposed over the first shaft, the side edges of the flexible protective cover being fixed to the curled coil springs, a curling nature of the curled coil springs providing the rolled protective cover.

3. The electrophotographic type processing unit as claimed in claim 2, wherein the moving means comprises:

a pair of first link arms having one ends rotatably supported by the rotation shaft and having another ends;

a second link arm rotatably supported by the rotation shaft and provided integrally with one of the first link arms;

a biasing means connected between the one of the first link arms and one of the side frames for urgedly rotating the first and the second link arms in the direction that said moving means moves to cover the exposed area a biasing force of the biasing means being greater than a combined biasing force of the pair of curled coil springs, and a movable shaft supported between the other ends of the first link arms for fixing the other end of the protective cover.

4. The electrophotographic type processing unit as claimed in claim 3, wherein the direction that the moving means moves to cover the exposed area is a first direction and the processing unit further comprises abutting means provided at a position abuttable with the second link arm for rotating the latter in a second direction opposite the first direction against the biasing force of the biasing means.

5. The electrophotographic type processing unit as claimed in claim 2, wherein the moving means comprises:

a movable shaft to which the other end of the protective cover is fixed;

a pair of manual knobs fixed to end portions of the movable shaft; and a pair of hooks fixed to a position adjacent to the other dead space, the pair of manual knobs being engageable with the pair of hooks.

6. The electrophotographic type processing unit as claimed in claim 1, wherein the protective cover has a thickness ranging from 50 to 200 micron meters.

7. The electrophotographic type processing unit as claimed in claim 6, wherein the protective cover is formed of a resin film selected from the group consisting of polyethylene terephthalate and low density polyethylene.

8. The electrophotographic type processing unit as claimed in claim 6 wherein the protective cover is formed of a fabric selected from the group consisting of polyethylene fiber, polyamide fiber and polyester fiber.

9. The electrophotographic type processing unit as claimed in claim 1, wherein the at least one image processing means comprises:

a developing means positioned at one side of the photosensitive drum; and a cleaning means positioned at another side of the photosensitive drum.

10. An image recording apparatus for electrostatically transferring toner image onto an image receiving sheet comprising:

a lower frame;

an upper frame pivotally movable with respect to the lower frame for providing both an open and closed position;

a processing unit detachably assembleable to the upper frame; the processing unit comprising:

an outer frame including a pair of side frames;

a photosensitive drum having an exposed area for electrostatically transferring a toner image, dead spaces being provided at both sides of the exposed area, the photosensitive drum being supported by a rotation shaft rotatably supported by the pair of side frames;

at least one image processing means disposed at a position adjacent the photosensitive drum;

a protective cover for covering the exposed area of the photosensitive drum during open state of the upper frame, the protective cover being formed of a flexible material and having one end, another end and side edges;

rolling means for rolling the protective cover during closing state of the upper frame to provide a rolled protective cover for retracting the protective cover away from the exposed area and for positioning the rolled protective cover in one of the dead spaces; and moving means for moving the protective cover in a direction to cover the exposed area.

11. The image recording apparatus as claimed in claim 10 wherein the rolling means comprises:

a first shaft supported between the pair of side frames and at a position adjacent the one of the dead spaces, the one end of the protective cover being fixed to the first shaft; and a pair of curled coil springs disposed over the first shaft, the side edges of the flexible protective cover being fixed to the curled coil springs, a curling nature of the curled coil springs providing the rolled protective cover.

12. The image recording apparatus as claimed in claim 11 wherein the moving means comprises:

a pair of first link arms having one ends rotatably supported by the rotation shaft and having another ends;

a second link arm rotatably supported by the rotation shaft and provided integrally with one of the first link arms;

a biasing means connected between the one of the first link arms and one of the side frames for urgedly rotating the first and the second link arms in the direction that said moving to cover the exposed area a biasing force of the biasing means greater than a combined biasing force of the pair of curled coil springs, and a movable shaft supported between the other ends of the first link arms for fixing the other end of the protective cover.

13. The image recording apparatus as claimed in claim 12 wherein the direction that the moving means to cover the exposed area is a first direction and the processing unit further comprises abutting means extending from the lower frame and provided at a position abuttable with the second link arm for rotating the latter in a second direction opposite the first direction against the biasing force of the biasing means when the upper frame is moved to the closed position.

14. The image recording apparatus as claimed in claim 10, wherein the protective cover has a thickness ranging from 50 to 200 micron meters.

15. The image recording apparatus as claimed in claim 14, wherein the protective cover is formed of a resin film selected from the group consisting of polyethylene terephthalate and low density polyethylene.

16. The image recording apparatus as claimed in claim 14 wherein the protective cover is formed of a fabric selected from the group consisting of polyethylene fiber, polyamide fiber and polyester fiber.

17. The image recording apparatus as claimed in claim 10, wherein the at least one image processing means comprises a developing means positioned at one side of the photosensitive drum; and a cleaning means positioned at another side of the photosensitive drum.

* * * * *